US009604770B2

(12) United States Patent
Glass et al.

(10) Patent No.: US 9,604,770 B2
(45) Date of Patent: Mar. 28, 2017

(54) MULTIPLE TRANSACTION CARD HOLDER

(71) Applicant: Gift Card Impressions, LLC, Kansas City, MO (US)

(72) Inventors: Brett R. Glass, Kansas City, MO (US); Nicole E. Glass, Kansas Dity, MO (US)

(73) Assignee: Gift Card Impressions, LLC, Kansas City, MO (US)

( * ) Notice: Subject to any disclaimer, the term of this patent is extended or adjusted under 35 U.S.C. 154(b) by 199 days.

(21) Appl. No.: 14/070,284

(22) Filed: Nov. 1, 2013

(65) Prior Publication Data

US 2014/0054187 A1 Feb. 27, 2014

Related U.S. Application Data

(63) Continuation-in-part of application No. 13/734,881, filed on Jan. 4, 2013, now Pat. No. 9,359,107.

(60) Provisional application No. 61/582,987, filed on Jan. 4, 2012.

(51) Int. Cl.

| | |
|---|---|
| ***B65D 85/48*** | (2006.01) |
| ***B65D 75/36*** | (2006.01) |
| ***B65D 85/62*** | (2006.01) |
| ***A45C 11/18*** | (2006.01) |
| ***B65D 65/12*** | (2006.01) |
| ***B65D 73/00*** | (2006.01) |

(52) U.S. Cl.

CPC ..... *B65D 75/368* (2013.01); *A45C 11/182* (2013.01); *B65D 65/12* (2013.01); *B65D 73/0078* (2013.01); *B65D 75/367* (2013.01); *B65D 85/62* (2013.01)

(58) Field of Classification Search

CPC .. B65D 75/368; B65D 65/12; B65D 73/0078; B65D 75/367; B65D 85/62

USPC ... 206/37–39, 232, 425, 449, 461, 467, 470, 206/806; 40/124.06, 124.09, 124.11; 229/92.1, 92.8; 235/380, 486, 487

See application file for complete search history.

(56) References Cited

U.S. PATENT DOCUMENTS

| | | | | |
|---|---|---|---|---|
| 5,593,036 | A * | 1/1997 | Dyble | B65D 75/366 206/462 |
| 6,224,108 | B1 * | 5/2001 | Klure | B42D 15/025 206/39 |
| 6,957,737 | B1 * | 10/2005 | Frederickson | G06Q 20/3437 206/449 |
| 7,374,095 | B2 * | 5/2008 | Blank | B65D 27/00 235/380 |
| 8,584,841 | B1 * | 11/2013 | Tiegs | B65D 69/00 206/471 |
| 2008/0116088 | A1 * | 5/2008 | Roberts | B42D 15/042 206/459.5 |
| 2009/0218392 | A1 * | 9/2009 | Biskupski | B65D 73/0014 235/487 |
| 2009/0218408 | A1 * | 9/2009 | Biskupski | B65D 73/0028 206/39 |
| 2009/0283594 | A1 * | 11/2009 | Walton | G06Q 30/06 235/383 |

(Continued)

*Primary Examiner* — Luan K Bui

(74) *Attorney, Agent, or Firm* — Polsinelli PC

(57) ABSTRACT

A card holder assembly for holding multiple transaction cards, such as gift cards, to a common backer panel for presentation and sale. Cards held within the container may be from a variety of retailers. The cards may also be activated with accessing each individual card and without removing the cards from the card holder assembly.

18 Claims, 20 Drawing Sheets

(56) References Cited

U.S. PATENT DOCUMENTS

2010/0219099 A1* 9/2010 Schmitt ..... B65D 75/305
206/39

* cited by examiner

MULTIPLE TRANSACTION CARD HOLDER

CROSS REFERENCE TO RELATED APPLICATIONS

This application is a continuation-in-part to pending U.S. patent application Ser. No. 13/734,881, filed on Jan. 4, 2013, U.S. Pat. No. 9,359,107, which claims the benefit of U.S. Provisional Application No. 61/582,987, filed Jan. 4, 2012; the contents of the above identified applications are incorporated herein by reference in their entireties.

BACKGROUND OF THE INVENTION

This invention relates generally to transaction card holders and more particularly to a card holder for holding multiple transaction cards, such as gift cards, within an assembly that allows the cards to be scanned by a card reader without detachment from the holder.

Transaction cards, stored value cards, or gift cards, as they are commonly called, based upon their intended use, have become popular gifts. Gift cards typically comprise a stored value card whereby a certain cash equivalent value is encoded upon a magnetic strip applied to the surface of the card. This stored value may be determined by the vendor prior to packaging and display for sale or may be selected at the point of sale by the purchaser and loaded by the cashier using a magnetic card reader/writer. As an alternative to a magnetic strip, a transaction card may use a bar code to link the card to an account by which the associated value is stored in a computer database. While popular, gift cards are typically provided with a generic and impersonal design, typically identifying the associated merchant for which the card may be used to purchase merchandise, and therefore are not personalized in view of the intended recipient. Gift cards are often presented for sale on display racks in stores, each card or packet of cards being hung upon a display stand peg. A given area of a store will only support a certain number and size of display stands, given store traffic and other considerations, which makes allocation of display space an important marketing decision that may require selecting only certain high selling cards for display. Display of other items in the same store area will typically reduce the substantially finite space available for displaying gift cards and gift card packets. What is needed is a device for displaying multiple cards in an integrated package that also allows for scanning of each card without detachment from the package

SUMMARY

The present disclosure relates to a card holder assembly for holding multiple transaction cards, such as gift cards, to a common backer panel for presentation and sale. The assembly provides certain structures for enabling cards held thereto to be lifted away from the assembly for scanning by a card reader without necessitating removal of the cards. The assembly also provides for bundling and sale of multiple cards associated with multiple different vendors in one unit. An embodiment of the card holder assembly may include a backer panel, foldable tabs for holding transaction cards thereto, and envelopes corresponding to each card and also attached to the assembly for later use by a purchaser.

In one embodiment the card holder assembly includes an elongated backer panel and a cover enclosure that includes one or more coplanar projection tabs. The cover enclosure also defines at least one transaction card portion dimensioned to hold at least one transaction card and defines at least one transaction card holder portion dimensioned to hold at least one transaction card holder. The projection tabs of the cover enclosure engage the elongated backer panel to hold the cover to the backer panel.

Other advantages of the invention will become apparent from the following description taken in connection with the accompanying drawings, wherein is set forth by way of illustration and example an embodiment of the present invention.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
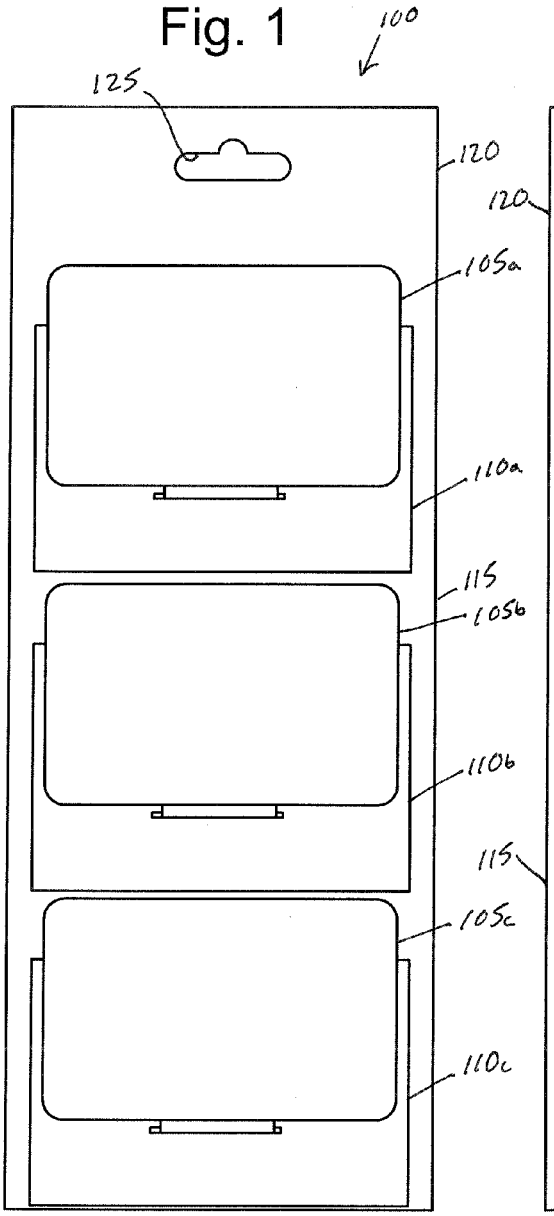
FIG. 1 is a front elevation view of a holder showing envelopes and transaction cards attached to the front surface of the backer panel.
Figure 2:
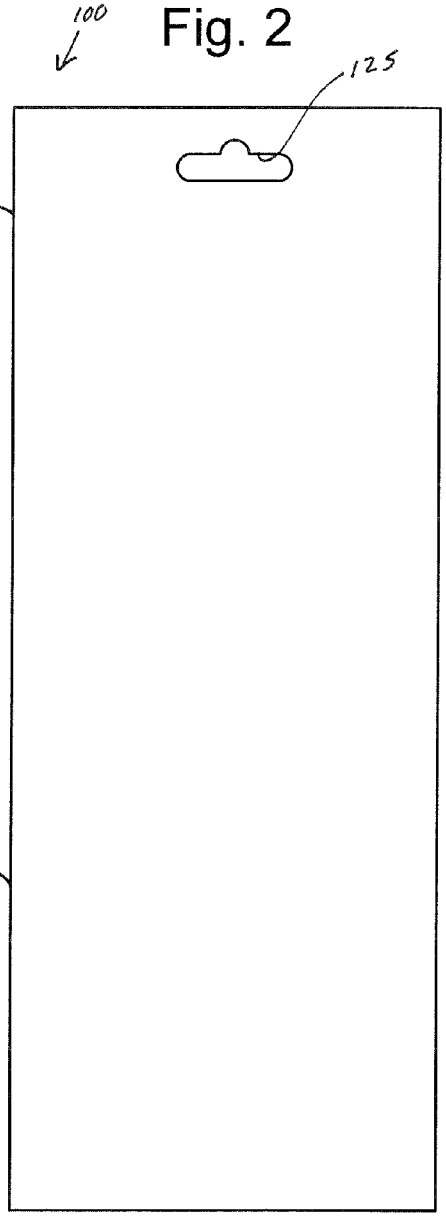
FIG. 2 is a rear elevation view of a holder showing the rear surface of the backer panel.

With reference to the figures, FIGS. 1-21 illustrate one or more embodiments of a card holder assembly 100 for holding multiple transaction cards 105 (such as gift cards) and corresponding envelopes 110. The holder assembly 100 includes a backer panel 115 to which the cards 105 and envelopes 110 are removably attached. FIG. 1 is a front elevation view of a card holder 100 showing transaction cards 105 and envelopes 110 attached to the front surface of the backer panel 115. FIG. 2 is a rear elevation view of the holder assembly 100 showing the rear surface of the backer panel 115, while FIG. 21 is a perspective view of the card holder 100. As illustrated, the backer panel 115 includes an upper header portion 120 having a centrally located aperture or peg hole 125 for receiving the peg of a product display stand (not shown).

Figure 3:
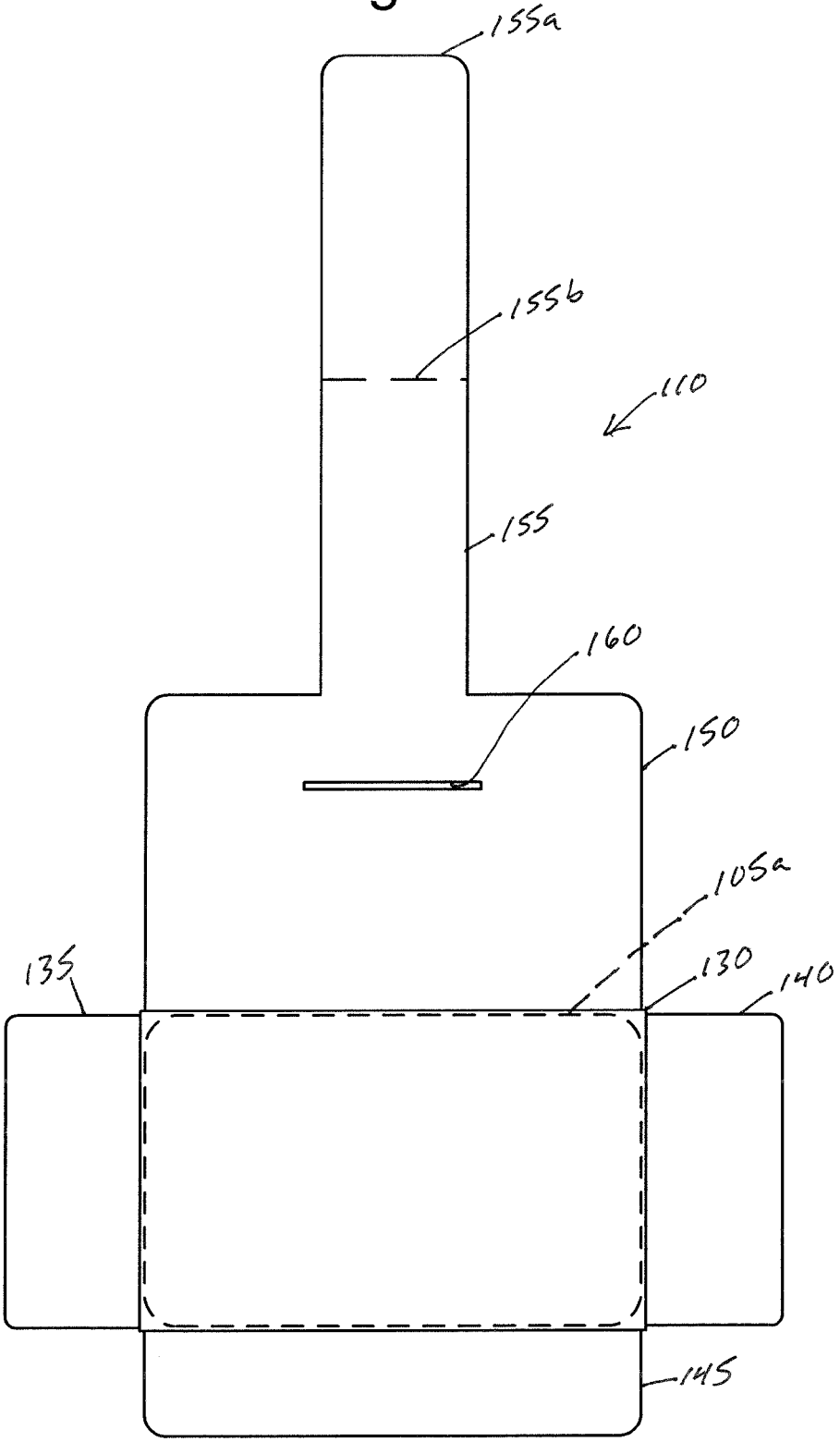
FIG. 3 is a plan view of an envelope in an unfolded disposition also showing positioning of a transaction card in phantom lines.

FIG. 3 is a plan view of an envelope 110 in an unfolded disposition. The envelope 110 includes a main panel 130, a first side flap 135 projecting from the left margin of the main panel 130, a second side flap 140 projecting from the right margin of the main panel 130, a bottom flap 145 projecting from the bottom margin of the main panel 130, and a top flap 150 projecting from the top margin of the main panel 130. The flaps 135, 140, 145 and 150 are hingedly connected to the main panel 130, typically via pre-scored fold lines therebetween, when the envelope 110 comprises a single piece of paper, card stock, or the like. The fold lines are typically formed by folding the flaps relative to the main panel 130 during assembly. The main panel 130 and flaps 135, 140, 145 and 150 extending therefrom comprise an envelope main body 111.

A tongue or strap 155 further projects from a top margin of the top flap 150 and may be likewise hingedly connected thereto along a fold line. The intended position or location of a transaction card 105 within the envelope 110 is shown in phantom lines. The top flap 150 includes an envelope slot 160 for receiving the distal end 155*a* of the tongue 155 after the tongue 155 is wrapped around the envelope 110 to secure the envelope 110 in a closed position, as described below. The tongue 155 may be provided with one or more pre-scored fold lines 155*b* to correspond to folds made in the tongue 155 when it is wrapped around the envelope 110 and/or secured to the backer panel 115. Alternatively, such folds may be made by bending the tongue 155 in the appropriate locations during assembly.

Figure 6:
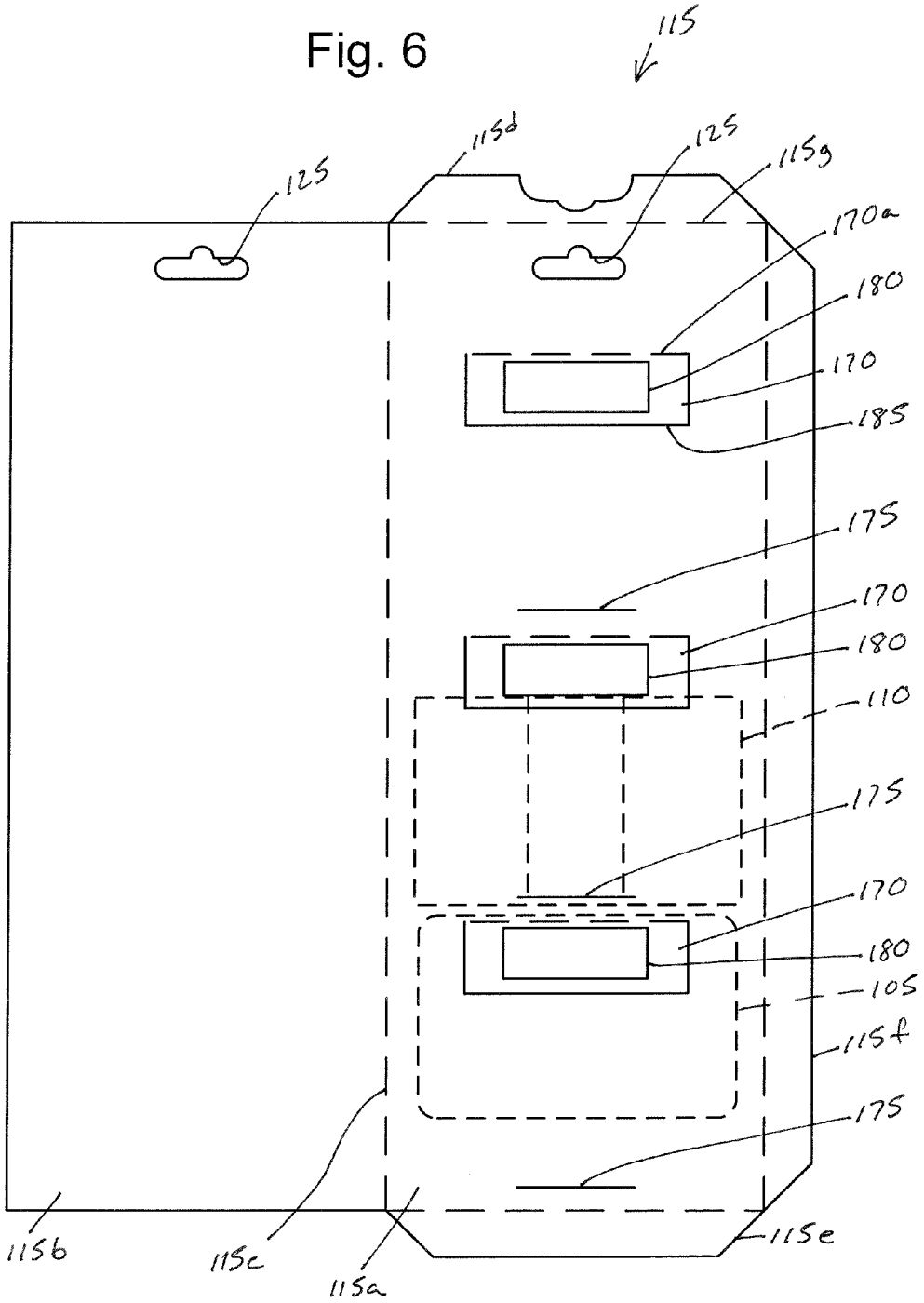
FIG. 6 is an elevation view of a backer panel in an unfolded disposition showing the backer panel front subpanel and rear subpanel joined to one another along an elongated, longitudinal hinge line, attachment flaps projecting from the top, bottom, and side margins of the front subpanel, as well as transaction card and envelope positioning.

Turning to the structure of the backer panel 115, FIG. 6 is an elevation view of a backer panel 115 in an unfolded disposition showing the backer panel front subpanel 115*a* and rear subpanel 115*b* joined to one another along an elongated, longitudinal hinge line 115*c*. A top attachment flap 115*d* projects upward from the top margin of the front subpanel 115*a*. A bottom attachment flap 115*e* projects downward from the bottom margin of the front subpanel 115*a*. A side attachment flap 115*f* projects rightward (as illustrated) from the side of the front subpanel 115*a* distal to the hinge line 115*c*.

The front subpanel 115*a* illustrated in FIG. 6 includes three pairs of foldable, backer panel tabs 170 and backer panel slits 175 to accommodate attachment of three pairs of transaction cards 105 and associated envelopes 110. Each tab 170 is cut on three contiguous sides from the material of the front subpanel 115*a* to form a structure that may either lie in the plane of the backer panel 115 or be folded away from the plane of the backer panel 115 by rotating or bending the tab 170 along a top fold line 170*a*. Removable adhesive 180 is applied to the front surface of each of the tabs 170 to adhere a card 105 to each tab 170 after the envelopes 110 are attached as shown in FIGS. 7 through 10.

To assemble the backer panel 115, adhesive is applied to the forward faces of flaps 115*d*, 115*e* and 115*f* and the flaps are folded back along fold lines 115*g* to lie behind the front subpanel 115*a*. The rear subpanel 115*b* is then folded backwards along hinge line 115*c* until it contacts and adheres to the flaps.

Figure 7:
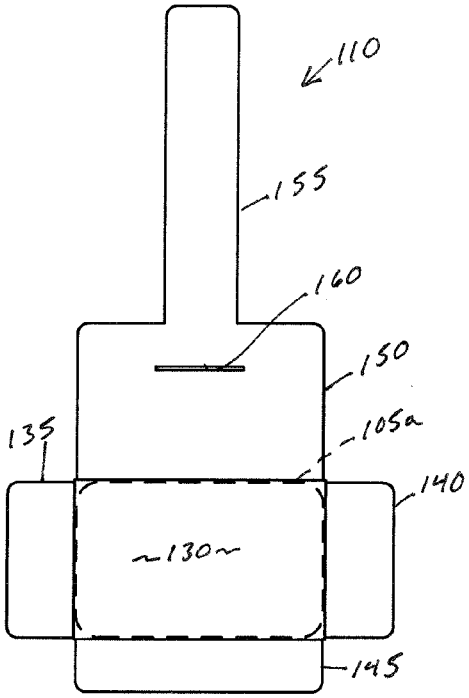
FIGS. 7 through 10 are a progression of images showing steps in the process of folding an envelope prior to installing the envelope upon the backer panel.
Figure 8:
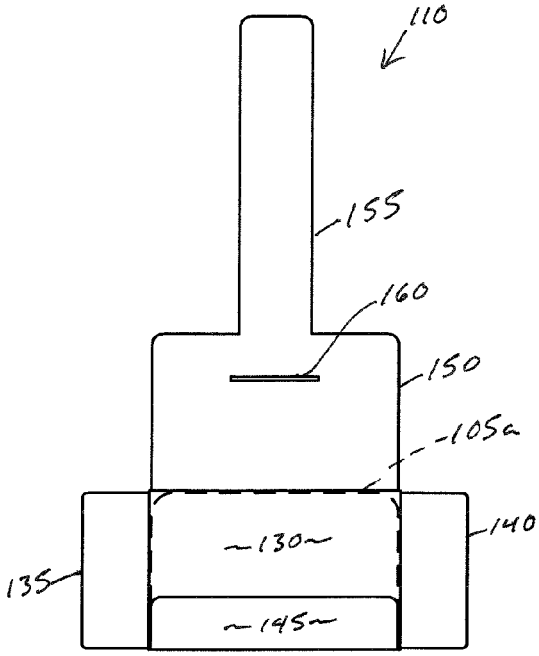
Figure 9:
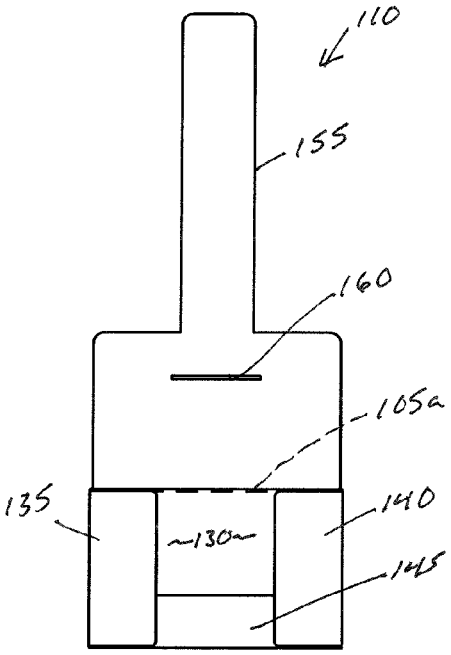
Figure 10:
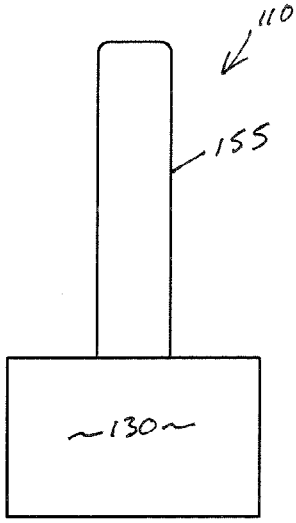

FIGS. 7 through 17 are a progression of images showing the folding, positioning and attachment of envelopes 110 upon a backer panel 115, in sequence. FIGS. 7 through 10 are a progression of images showing steps in the process of folding an envelope 110 prior to installing the envelope 110 upon the backer panel 115. FIG. 7 is a plan view of an envelope 110 in an unfolded disposition. FIG. 8 shows the bottom flap 145 folded inward and upward upon the main panel 130. FIG. 9 shows the side flaps 135 and 140 folded inward and upon the main panel 130. FIG. 10 shows the main panel 130 folded upward and upon the top flap 150, such that the back surface of the main panel 130 is facing upward in FIG. 10.

Figure 11:
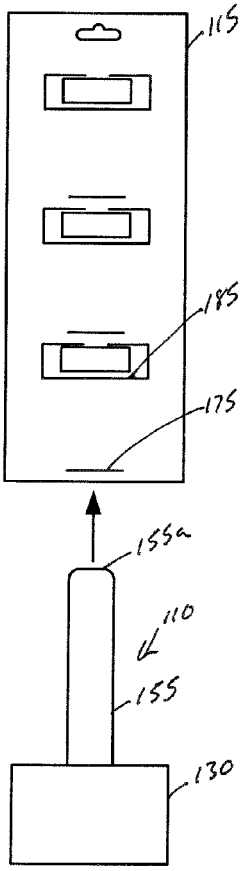
FIGS. 11 through 17 are a progression of images showing the positioning and attachment of envelopes and gift cards upon a backer panel.
Figure 12:
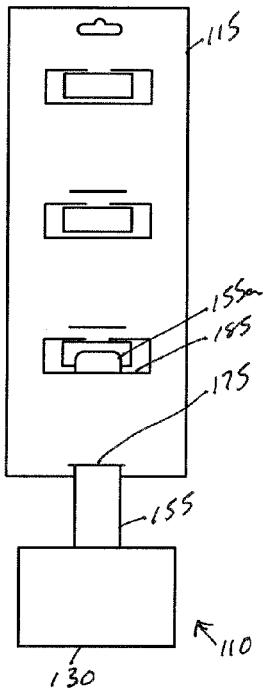

FIGS. 11 through 17 are a progression of images showing the positioning and attachment of envelopes 110 to the front subpanel 115*a* of the backer panel 115. FIG. 11 shows an envelope 110 with the tongue 155 extended and the distal end 155*a* positioned to enter the lower backer panel slit 175 of a backer panel 115 front subpanel 115*a*. The distal end 155*a* of the tongue 155 is inserted into the backer panel slit 175 and pushed upward until it emerges from the opening 185 that is formed between the lower margin of a cooperating tab 170 and the portion of the subpanel 115*a* proximate thereto. FIG. 12 shows the tongue 155 passed inward through the slit 175, along the underside of the front subpanel 115*a* of the backer panel 115, the distal end 155*a* then extending outward through opening 185.

Figure 13:
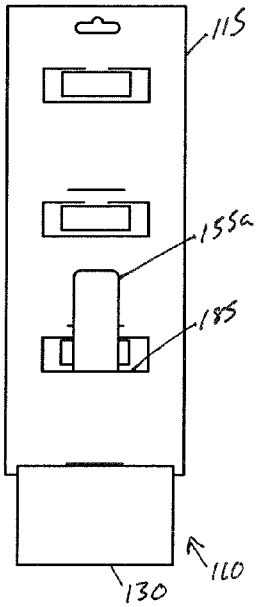
Figure 14:
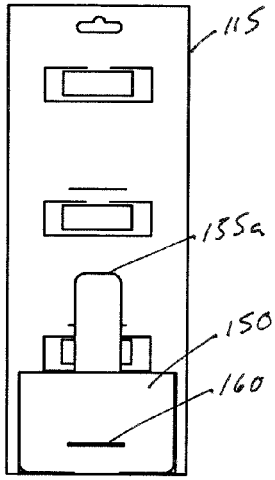
Figure 15:
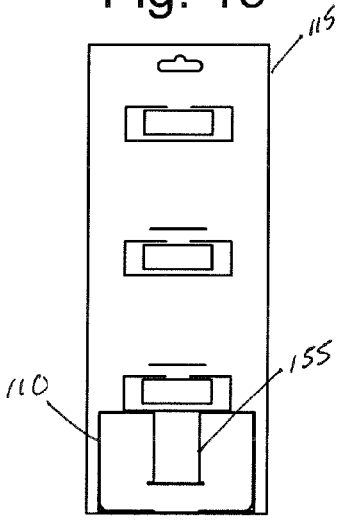

FIG. 13 shows the tongue 155 passed through slit 175 and opening 185, typically until the main body 111 abuts the edges of the slit 175. The main body 111 is flipped upward so that the top flap 150 now faces upward as shown in FIG. 14. The tongue 155 is then folded downward upon top flap 150 and the distal end 155*a* of the tongue 155 is inserted into the envelope slot 160 to secure the envelope 110 in a folded and closed disposition and to hold the envelope 110 in attachment to the backer panel 115.

Figure 16:
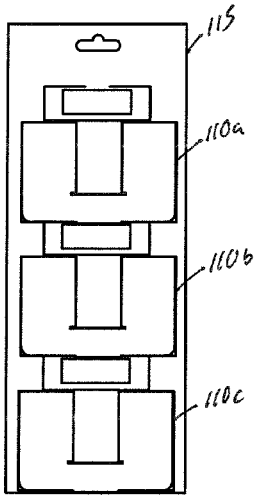
Figure 17:
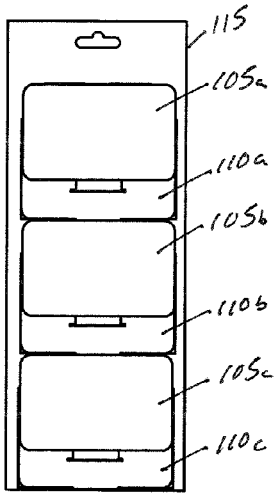

The above steps are repeated to attach envelopes 110 to all envelope positions on a backer panel 115. FIG. 16 shows multiple envelopes 110 attached to the backer panel 115, as occurs prior to subsequent attachment of cards 105 to the backer panel 115 and display of the holder assembly 100 for sale. FIG. 17 shows envelopes attached to all backer panel tabs 170.

Figure 18:
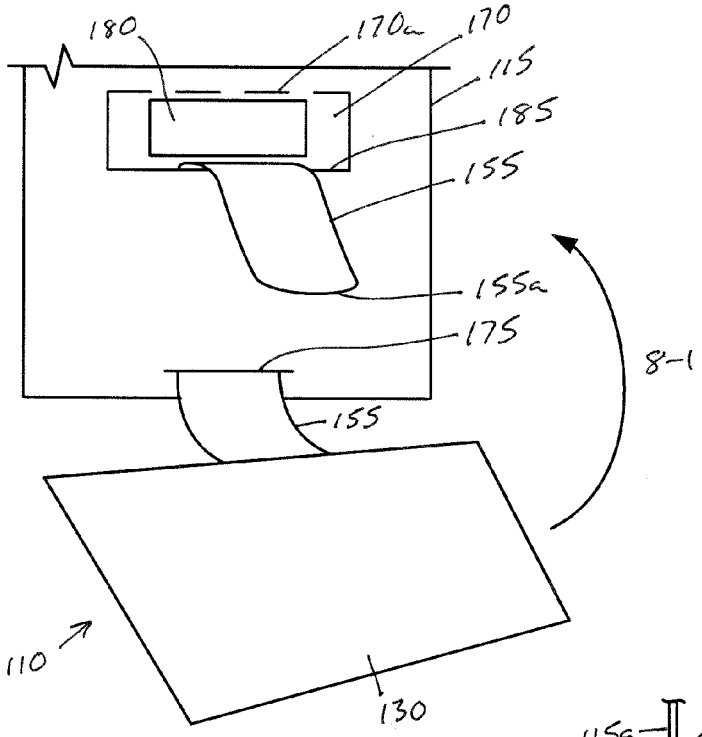
FIG. 18 is a perspective view of a backer panel and envelope showing the tongue of the envelope inserted into a backer panel slit and then passed through the opening formed by a cooperating/corresponding backer panel tab.
Figure 19:
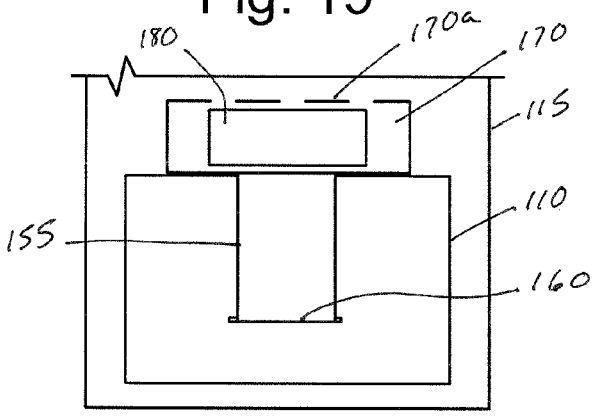
FIG. 19 is an elevation view showing the envelope attached to the backer panel.

FIG. 18 further illustrates attachment of an envelope 110 to a backer panel 115 and is a perspective view showing the tongue 155 inserted into a backer panel slit 175 and then passed back out through the opening 185. As indicated by arrow 8-1, the envelope 110 is then flipped or rotated upward to lie against the backer panel 115. As shown in FIG. 19, the tongue 155 is then inserted into the envelope slot 160.

Figure 4:
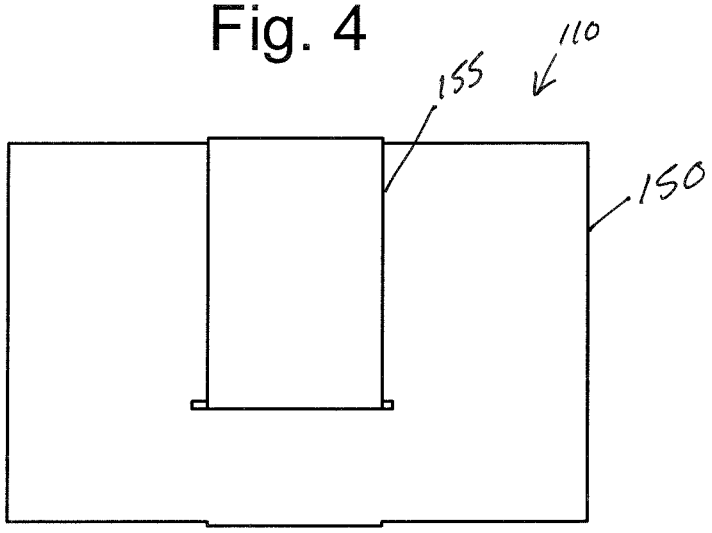
FIG. 4 is a is a front elevation view of an envelope in a fully folded disposition showing the envelope tongue inserted into the envelope slot to hold the envelope closed.
Figure 5:
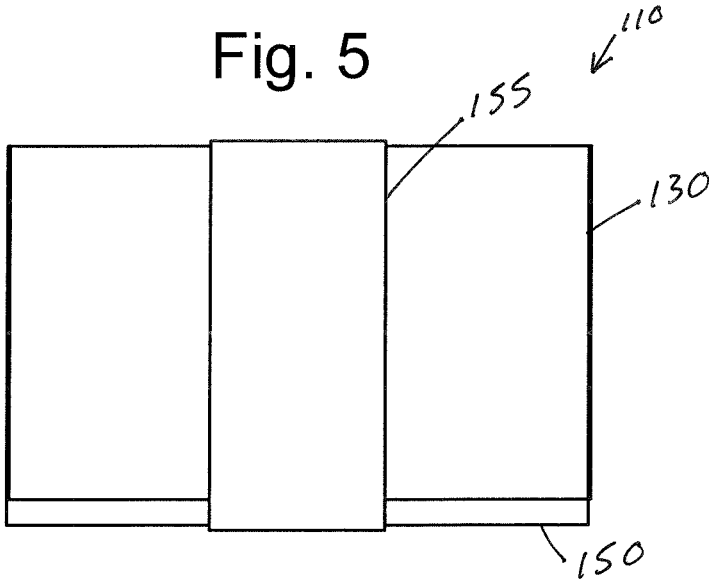
FIG. 5 is a rear elevation view of the envelope of FIG. 4.

After purchase of a card holder assembly 100, the purchaser typically removes the cards 105 and envelopes 110 and encloses each card 105 within an envelope 110. Returning to FIG. 3, placement of a transaction card 105 within an opened envelope 110 is indicated in phantom lines 105. After placement of card 105 upon the main panel 130, as shown, the side and bottom flaps 135, 140, and 145 are folded in upon the card 105 and the top flap 150 folded down upon the side and bottom flaps 135, 140 and 145. Turning to FIGS. 4 and 5, the tongue 155 may then be folded downward and the distal end 155*a* thereof inserted into the envelope slot 160 to place the envelope 110 in a fully closed position as shown in FIG. 4. FIG. 4 is a is a front elevation view of an envelope 110 in a fully folded disposition showing the tongue 155 inserted into the envelope slot 160 to hold the envelope 110 closed. FIG. 5 is a rear elevation view of the envelope 110. The envelope 110 is typically placed in such a closed disposition after a gift card or other transaction card 105 is placed therein and prior to presenting the envelope 110 bearing the card 105 to a recipient.

Figure 20:
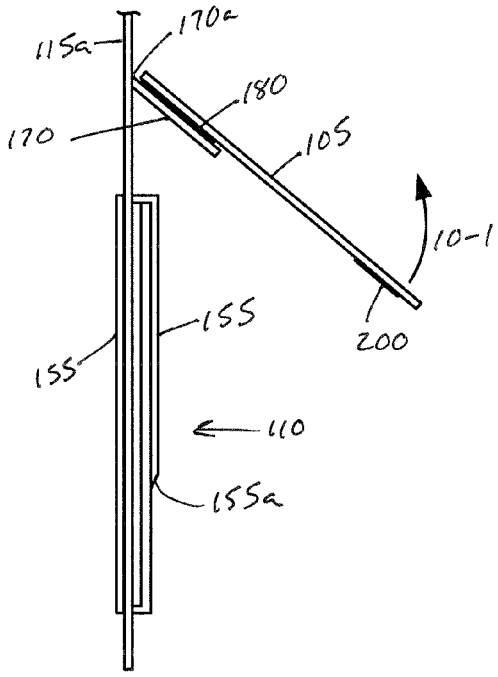
FIG. 20 is a partial, side, diagram view showing the transaction card lifted away from the front subpanel of the backer panel in order to reveal a magnetic strip on the rear surface of the card for scanning.
Figure 21:
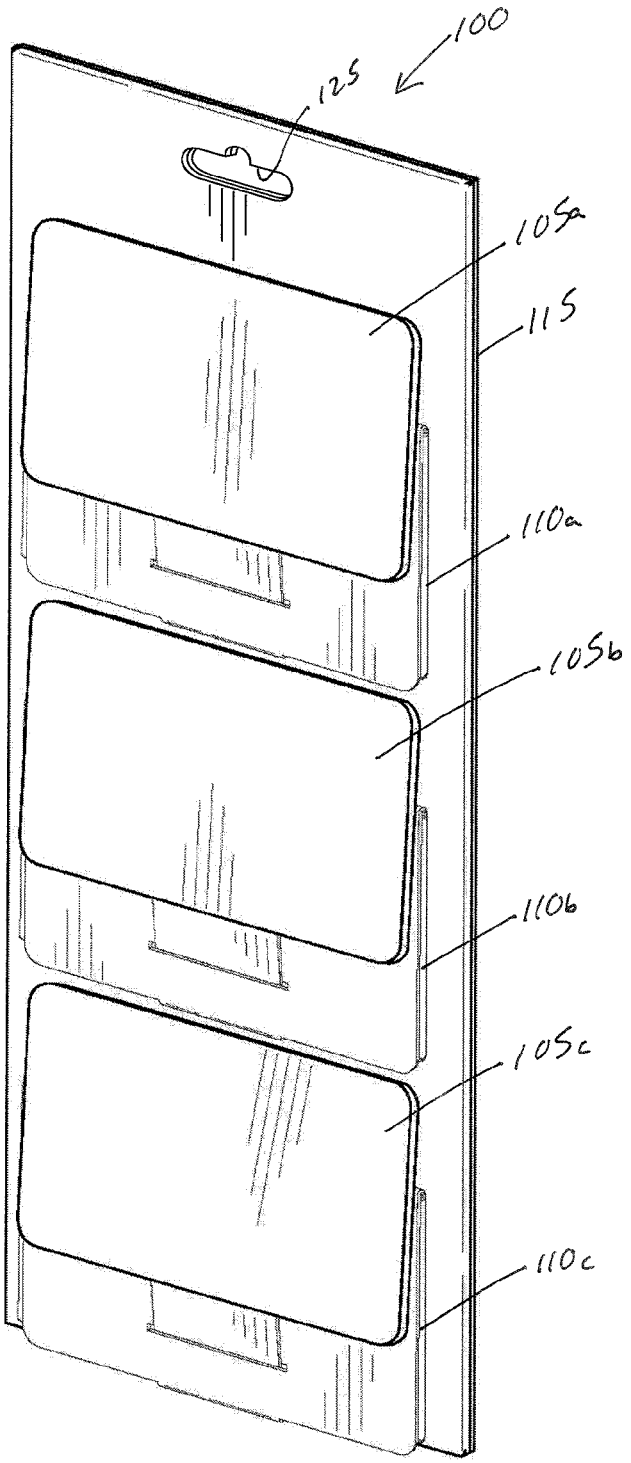
FIG. 21 is a perspective view of a holder showing envelopes and transaction cards attached to the front surface of the backer panel.

FIG. 20 is a partial, side, diagram view showing the transaction card 105 lifted away in the direction of arrow 10-1 from the front subpanel 115*a* of the backer panel (the rear subpanel is omitted for clarity) in order to reveal a magnetic strip 200 on the rear surface of the card and make it accessible for scanning without the necessity of removing the card 105 from the assembly 100. In certain embodiments the magnetic strip 200 of each card 105 is scanned individually at the point of sale to activate, while in other embodiments scanning a bar code or UPC code typically provided on the surface of the backer panel 115 or packaging activates all cards 105 in the assembly 100. In still further embodiments, scanning the magnetic strip 200 of any one of the cards 105 of the assembly 100 activates all cards 105 of the assembly 100.

Figure 22:
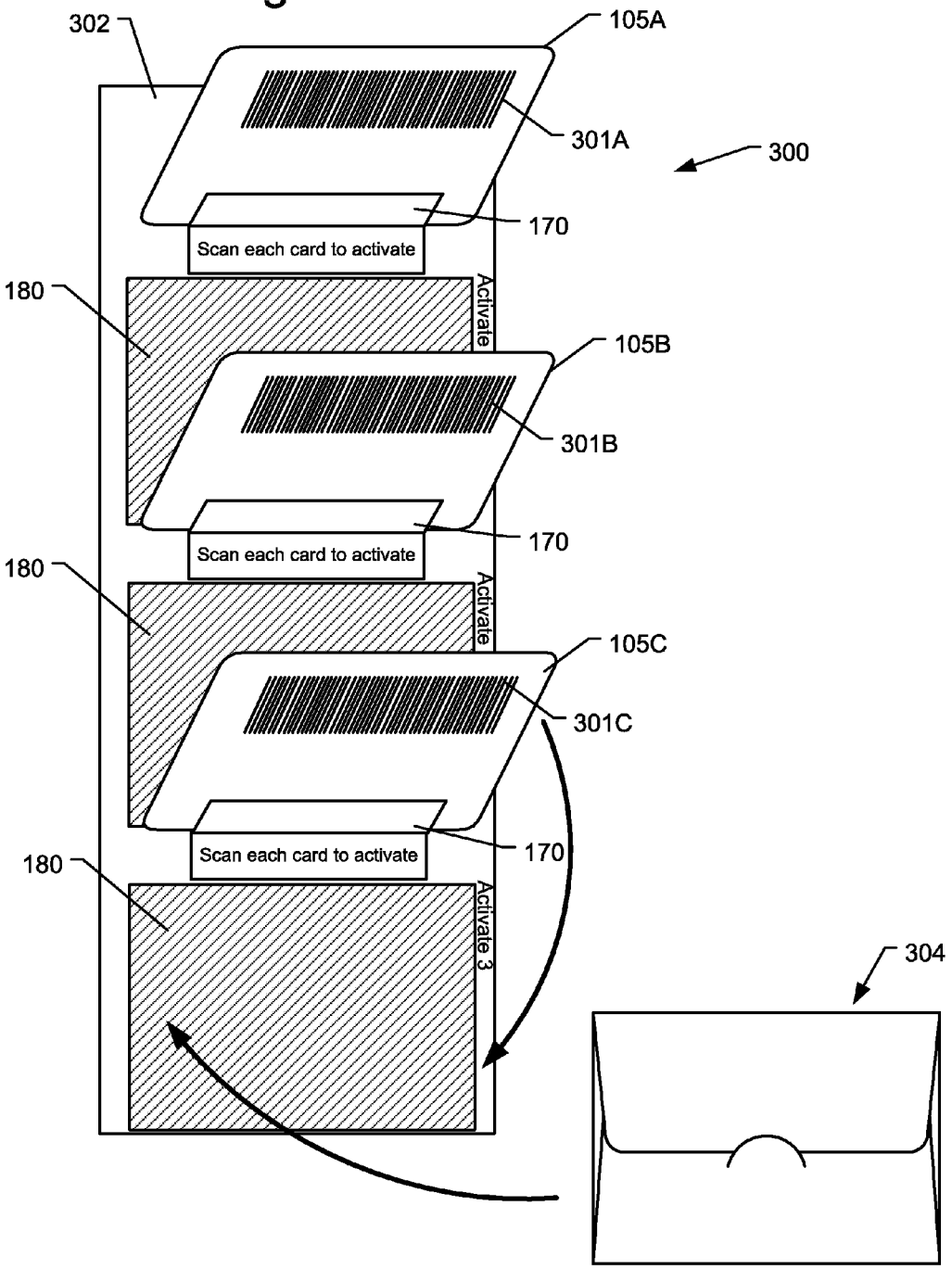
FIG. 22 is a diagram view showing transaction cards attached to backer panel tabs.
Figure 23:
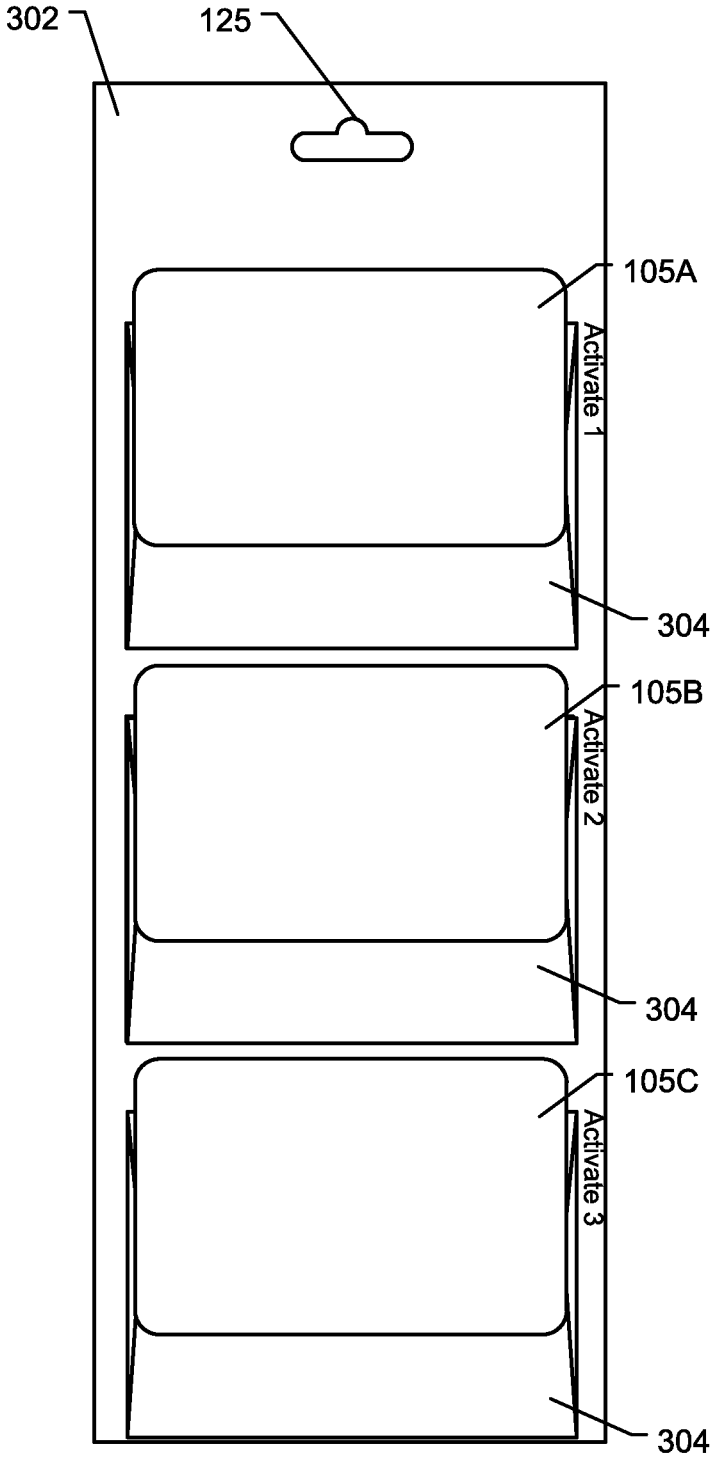
FIG. 23 is a front elevation view of transaction cards and envelopes attached to a backer panel.

FIGS. 22 and 23 depict another embodiment of the card holder assembly 300. As shown, this embodiment includes a backer panel 302 and one or more gift cards 105A-C that are hingedly engaged to the backer panel via backer panel tabs or flaps 170. The flaps 170 permit the gift cards 105A-C to be lifted or pivoted away from the back panel 302 to expose activation indicia 301A-C. The activation indicia 301A-C may be in any form, including but not limited to a bar code, a UPC code, a serial number, a Quick Response (QR) Code, or financial instrument or account identifier. In various aspects, the activation indicia 301A-C may be recorded in a machine readable magnetic strip. In one embodiment, as shown in FIG. 22, the cards 105A-C have different activation indicia 301A-C, and each card must be scanned to activate the gift cards. In other embodiments, the activation indicia 301A-C may be the same for all the gift cards 105A-C, such that scanning, swiping, or otherwise reading the activation indicia for a single gift card activates all of the gift cards for the card holder assembly 300.

The card holder assembly 300 also includes at least one envelope 304 for each of the gift cards 150A-C. The envelopes 303 are engaged to the backer panel 302 by a removable adhesive placed within one or more adhesive regions, generally indicated as 180, on the backer panel 302. After each envelope 304 is engaged to adhesive regions 180 of the back panel 302, the gift cards 105A-C are positioned to lie on top of each corresponding envelope 304.

Figure 24:
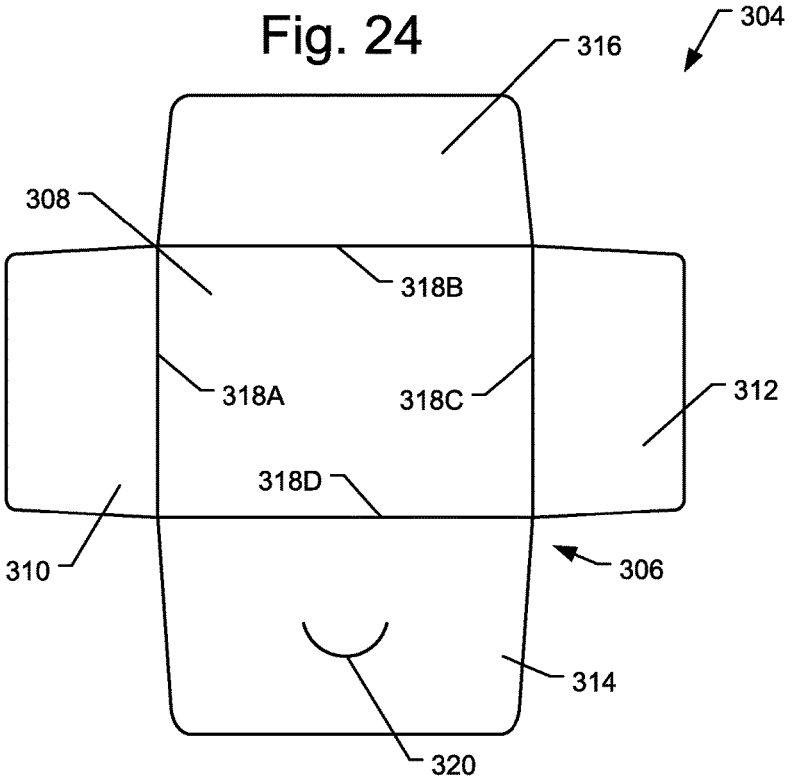
FIG. 24 is a plan view of an open envelope.
Figure 25:
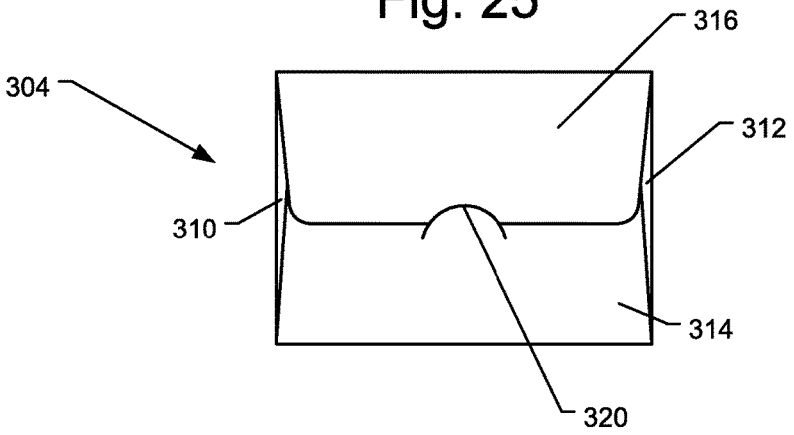
FIG. 25 is a plan view of a closed envelope.

FIGS. 24-25 depict one embodiment of an envelope 304 that may be used with various embodiments of the card holder assembly disclosed herein. The envelope 304 is formed from one or more layers of a planar material 306, including but not limited to paper, cardstock, plastic, or any other suitable materials, that is cut or scored to provide a back surface 308 with four or more panels or flaps 310-316 projecting there from. The projections include side panels 310-312, a front panel 314, and a top flap 316. The panels and flaps 310-316 are hingedly engaged to the back panel 308 along a number of fold lines 318A-D. In one aspect, the front panel 314 includes a slit or slot 320 to receive an edge of the top flap 316 when the envelope is in a closed configuration as shown in FIG. 25.

Figure 26:
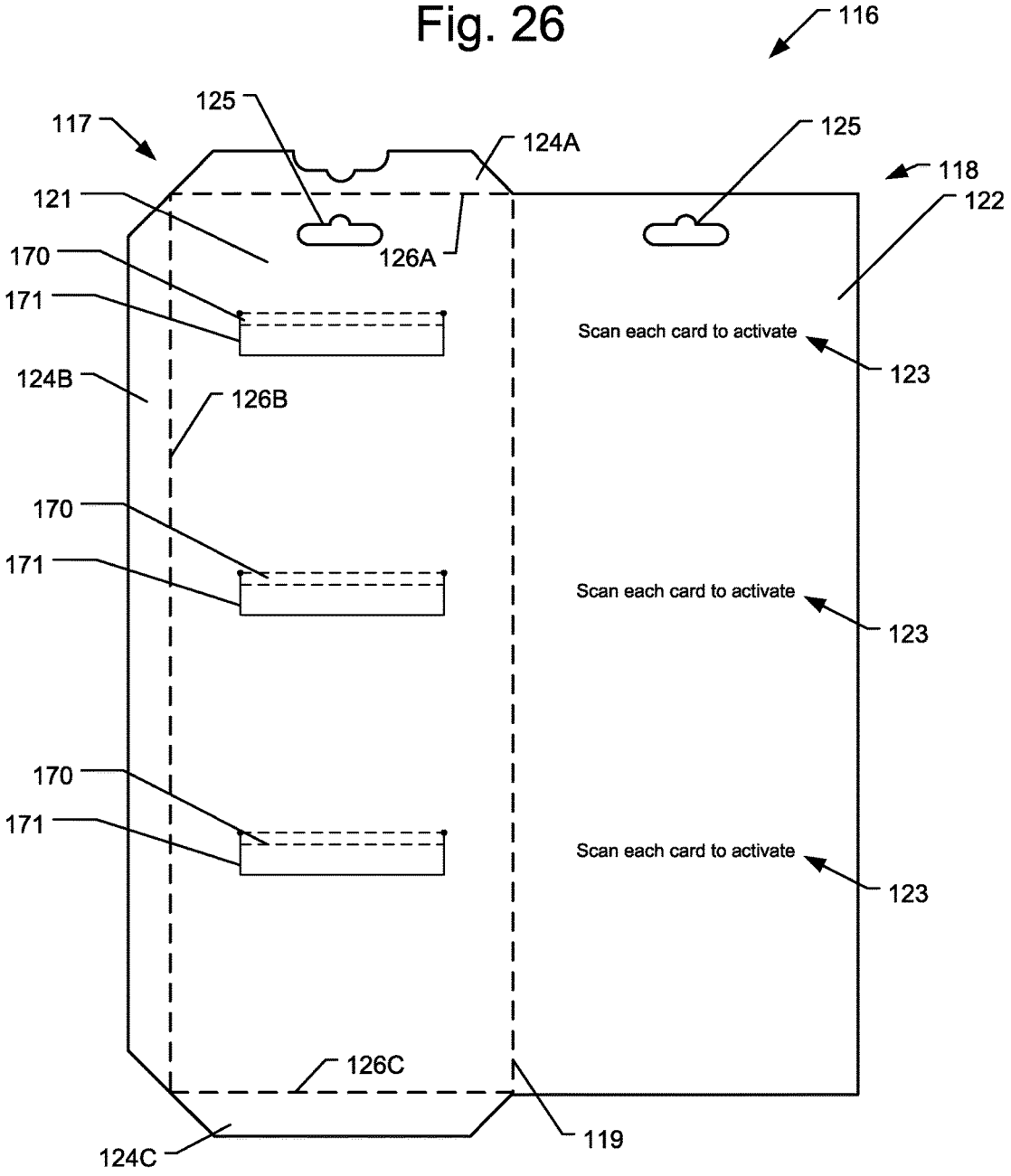
FIG. 26 is a top plan view of an unassembled backer panel used for multiple scan activation.

FIG. 26 depicts an embodiment of a multi-layer backer panel 116 that may be used with the card holder assemblies shown in FIGS. 1-22. The backer panel 116 includes a first panel 117 that is hingedly connected to a second panel 118 by a fold line 119. The first panel 117 includes a number of flaps 170 located adjacent to a number of corresponding openings 171 in the front panel. The flaps 170 are shown in broken lines as they project away from the back surface 121 of the front panel. When assembled, the back surface 121 of the first panel 117 contacts the front surface 122 of the second panel 118 as the first panel is pivoted about the fold line 119 to lie on top of the second panel. The openings 171 permit indicia 123 printed on the second panel 118 to be visible through the first panel 117.

As shown, the first panel includes co-planar tab projections 124A-C extending away from the front panel 117. The tab projections 124A-C are engaged to the front panel along fold lines 126A-C. When assembled, the tab projections are folded along the fold lines 126A-C to engage a back surface (not shown) of the second panel 118.

Figure 27:
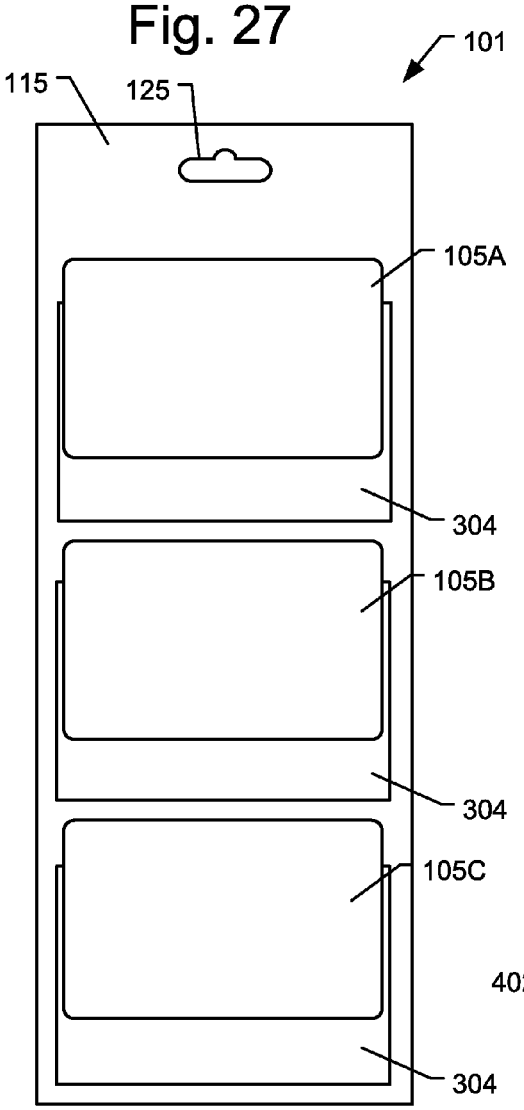
FIG. 27 is front elevation view of a backer panel used for single scan activation.
Figure 28:
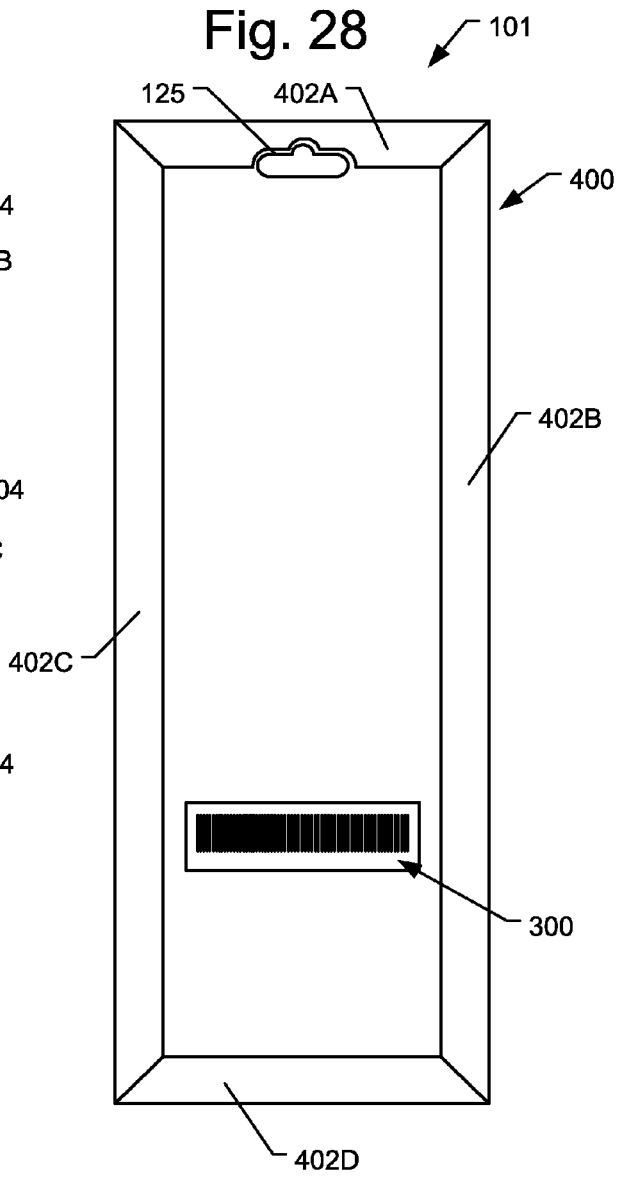
FIG. 28 is a rear elevation view of a backer panel used for single scan activation.
Figure 29:
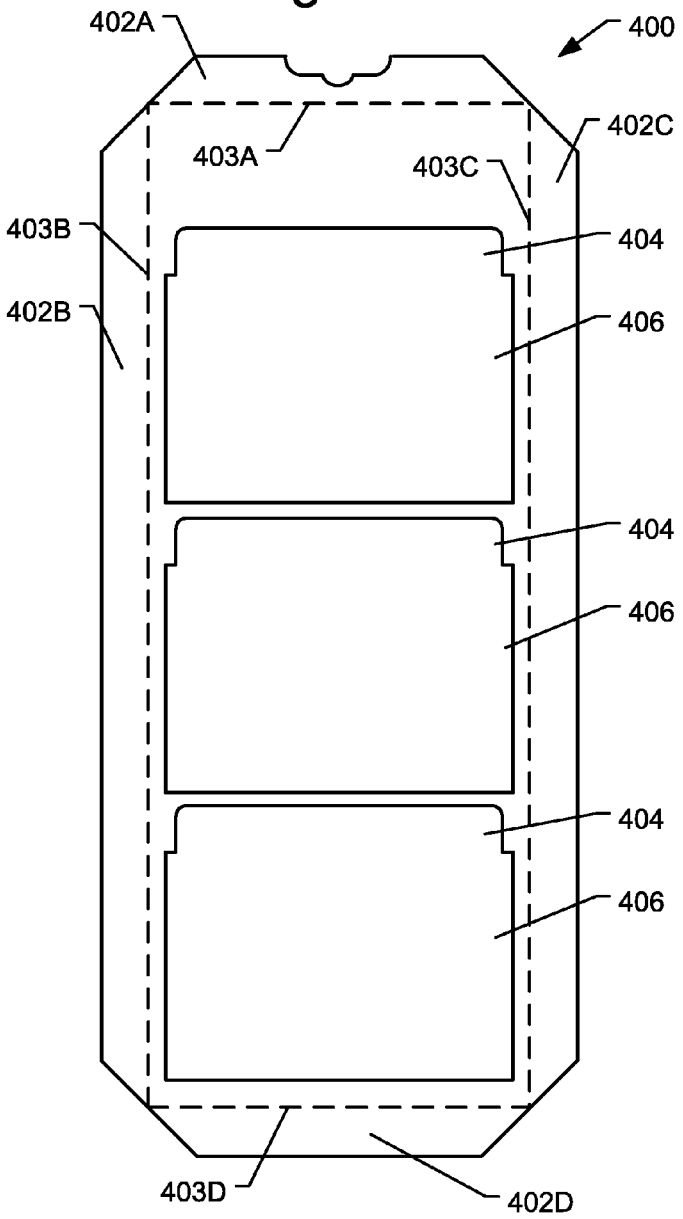
FIG. 29 is a top plan view of a clamshell cover typically comprising clear polyvinyl chloride.
Figure 30:
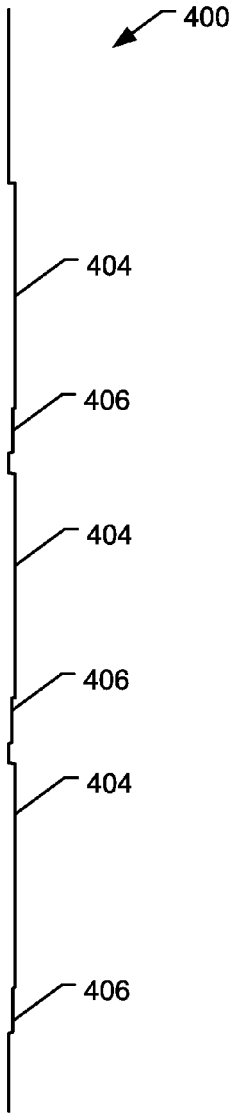
FIG. 30 is a cross sectional view of the cover of FIG. 29.

FIGS. 27 and 28 depict a complete card holder assembly 101 that includes a clamshell cover enclosure 400, shown in FIGS. 29-30. The card holder assembly 100 is substantially similar to the card holder assembly 100 of FIGS. 1-23. In one aspect, the clamshell cover 400 is transparent or at least translucent and may be composed of a polymer, including but not limited to molded polyvinyl chloride, acetate, or Polyethylene terephthalate glycol-modified (PETG). As shown in FIGS. 29-30, the clamshell cover is dimensioned to fit over the backer panel 115, as well as the engaged gift cards 105A-C and envelopes 304. To fit on the backer panel 115, the clamshell cover defines one or more gift card holding regions 404 and envelope holding regions 406. In one embodiment, the gift card holding regions 404 and the envelopes holding regions are stacked a top one another. In another embodiment, the gift card holding region 404 and the envelope holding region 406 may be separated from one another by a portion of the clamshell cover 400 and/or the backer panel 115 or 116.

The clamshell cover 400 includes co-planar tab projections 402A-D extending away from the cover. The projections 402A-D are hingedly engaged to the clamshell cover 400 by folds 403A-D in the clamshell cover. The tab projections 402A-D extend beyond the portions of the clamshell surface that contact a front surface of the backer panel 115, indicated as the region bound by the fold lines 403A-D.

To secure the clamshell cover 400 to the card holder assembly 100, the tab projections 402A-D are pivoted along the respective fold lines 403A-D such that the projections engage the back surface of the backer panel as shown in FIG. 28.

In one embodiment, the clamshell cover 400 prevents direct access to the gift cards 105A-C; therefore, a single activation indicia 300 is used to activate the gift cards 105A-C. As shown in FIG. 28, the card holder assembly may include a single activation indicia 300 printed on the back surface of the backer panel that may activate one or more of the gift cards 105A-C associated with the card holder assembly 100. In another embodiment, the backer panel may define one or more openings that permit activation indicia on one or more of the gift cards 105A-C to be visible or otherwise accessible through the backer panel, such that the gift cards may be activated when a clamshell cover is in place.

FIGS. 31-36 depict other embodiments of a card holder assembly 500. In one embodiment, the card holder assembly 500 holds and displays one or more gift cards 105 in an upper portion 502 of the assembly, while a corresponding number of envelopes, such as the envelope 304 for example, are stored in a lower portion 504. In various other embodiments, the portion for holding the envelopes may be above or next to the portion of the assembly for holding the gift cards.

Figure 31:
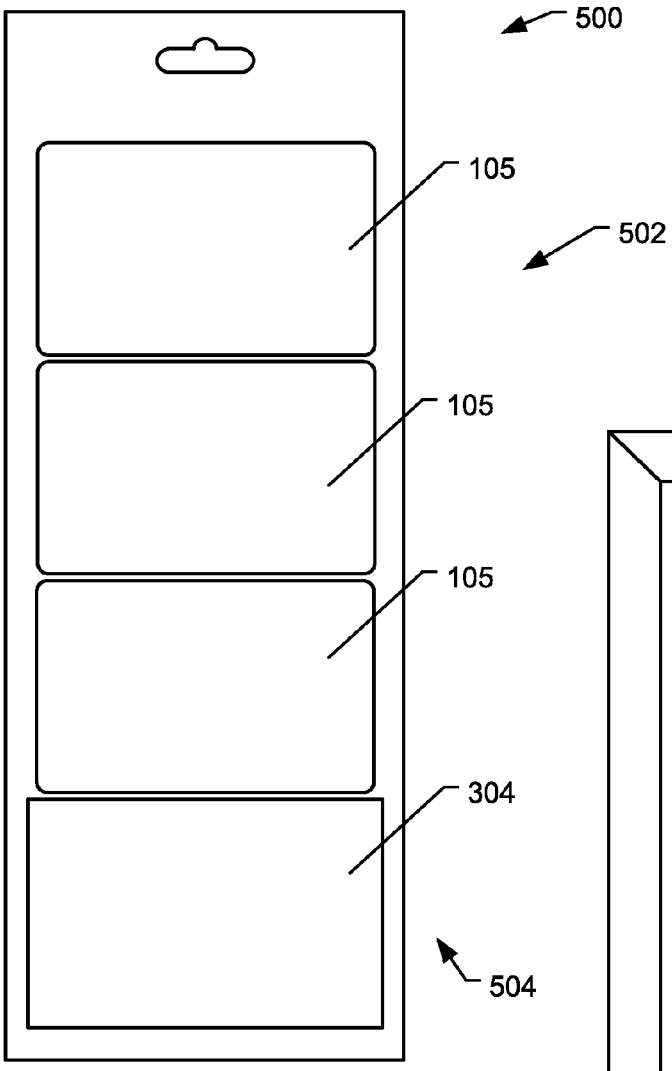
FIG. 31 is a front elevation view of a backer panel used for single scan activation showing envelopes held in stacked configuration at a bottom or lower portion of the backer panel.
Figure 32:
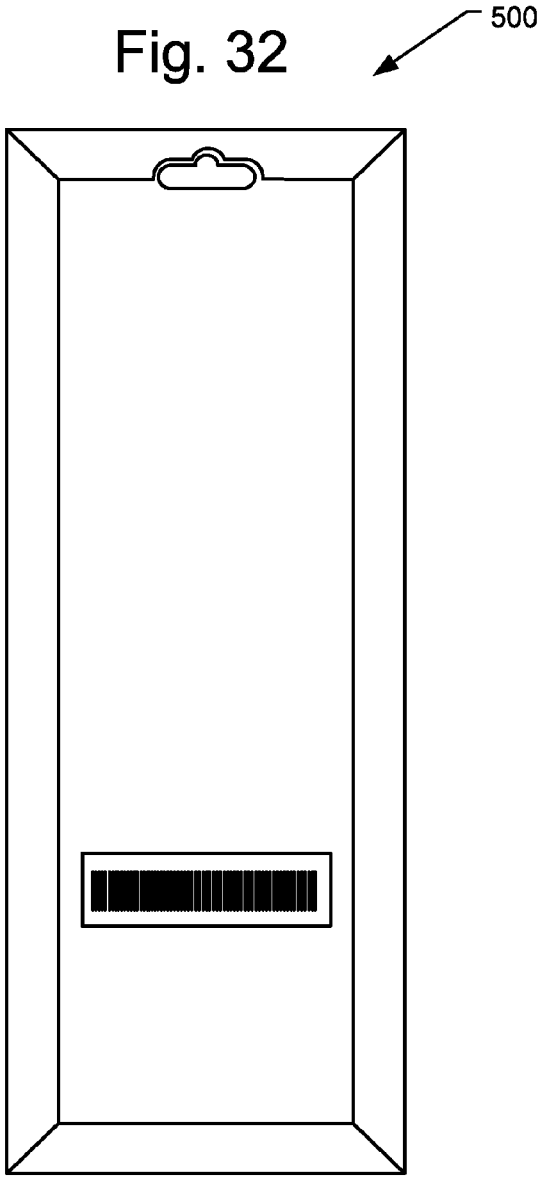
FIG. 32 is a rear elevation view of the backer panel of FIG. 31.

In one embodiment, the gift cards 105 may be held individually in separate positions, as shown in FIG. 31. In various other embodiments, however, two or more gift cards may be stacked in the upper portion 500. For example, the gift cards 105 may be stacked such that only the topmost card is visible. In another example, the gift cards 105 may be in a fanned stack arrangement such that the topmost card is visible while only a portion of one or more remaining cards is visible. Other arrangements for displaying the gift cards 105 may also be used.

Figure 33:
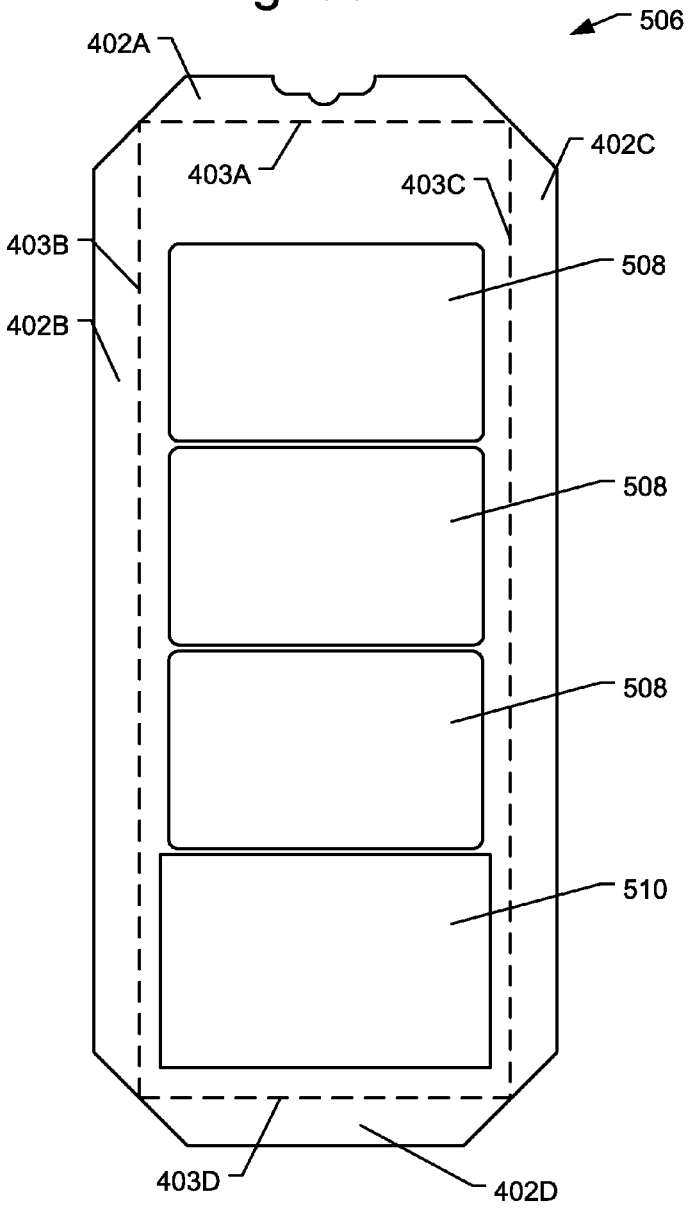
FIG. 33 is a top plan view of a clamshell cover typically comprising clear polyvinyl chloride.
Figure 34:
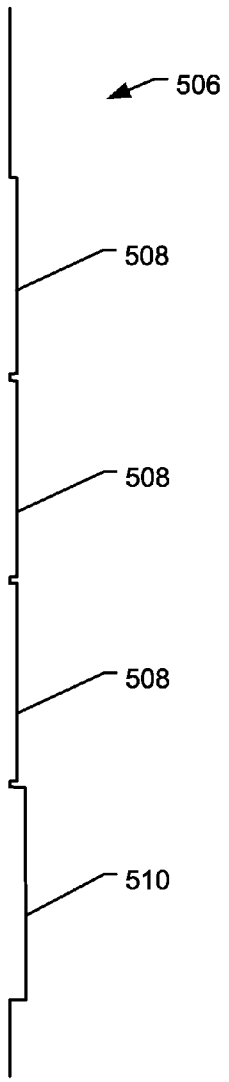
FIG. 34 is a cross sectional view of the cover of FIG. 33.

As shown in FIGS. 33 and 34, a clamshell cover 506 similar to the clamshell cover 400 shown in FIGS. 29 and 30, including similar coplanar projections 402A-D and fold lines 403A-D, may be engaged to the card holder assembly 100. The clamshell cover includes one or more distinct card holding portions 508 and an envelope holding portion 510. As shown in one embodiment, the envelope holding portion 510 is typically larger to accommodate a stack of envelopes corresponding to each gift card. However, in other embodiments, the envelopes may be a held separately, in a fanned stack arrangement, or in a fanned arrangement. Moreover, in yet another embodiment, the envelope may be dimensioned to hold two or more gift cards 105, such that the number of envelops provided with the card holder assembly 100 may be less than the number of gift cards.

Figure 35:
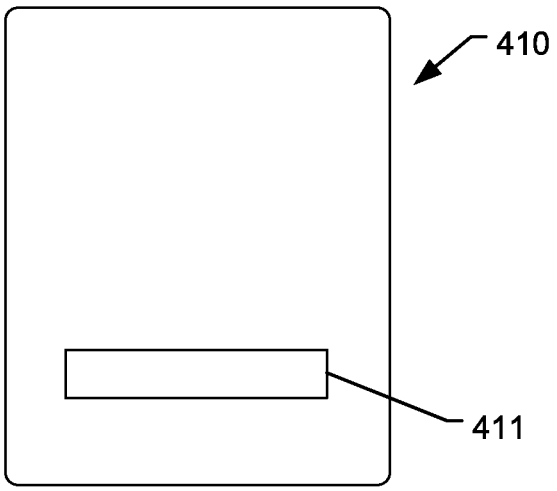
FIG. 35 is a front elevation view of a backer panel used for single or parent card activation.
Figure 36:
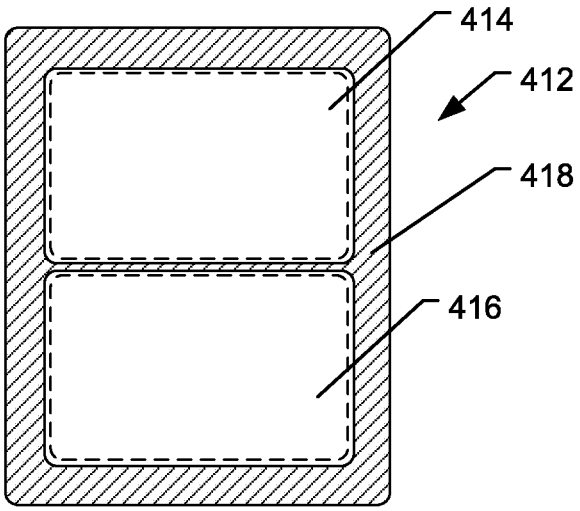
FIG. 36 is a rear view of a clamshell cover typically comprising clear, molded polyvinyl chloride, acetate, or PETG, the shaded portions indicating adhesive for adhering the cover to the backer panel of FIG. 35.
Figure 37:
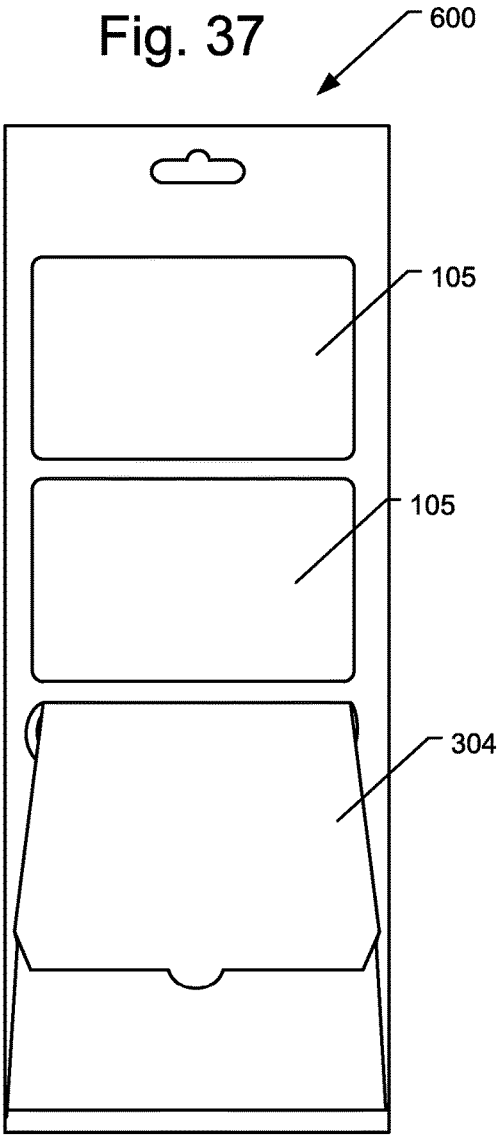
FIG. 37 is a front elevation view of a backer panel showing transaction cards held theron and a purse-shaped transaction card holder mounted on a bottom or lower portion of the backer panel.

FIGS. 35 and 36 depict components of another embodiment of a single-activation card holder assembly. The backer panel 410 defines an opening 411 for single activation, wherein a single activation indicia is used to active gift cards that may be attached to the backer panel. FIG. 36 depicts a clamshell cover 412 that may be adhered to a backer panel. As shown, the clamshell cover 412 may define a gift card holding region 414, an envelope holding region 416, and a peripheral region 414 about the periphery of the clamshell cover that may receive an adhesive for attachment to the backer panel 410.

Figure 38:
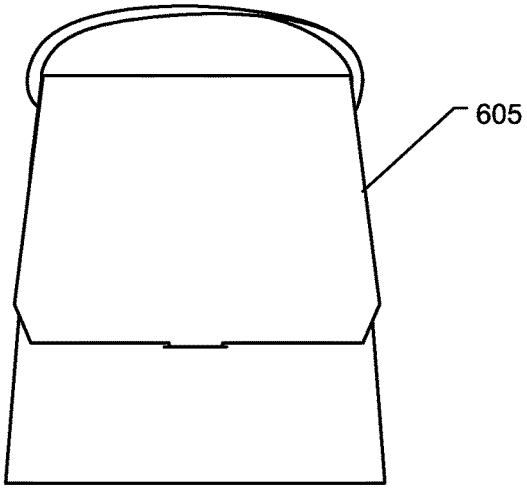
FIG. 38 is a front elevation view of the holder of FIG. 35 showing the holder flap closed.
Figure 39:
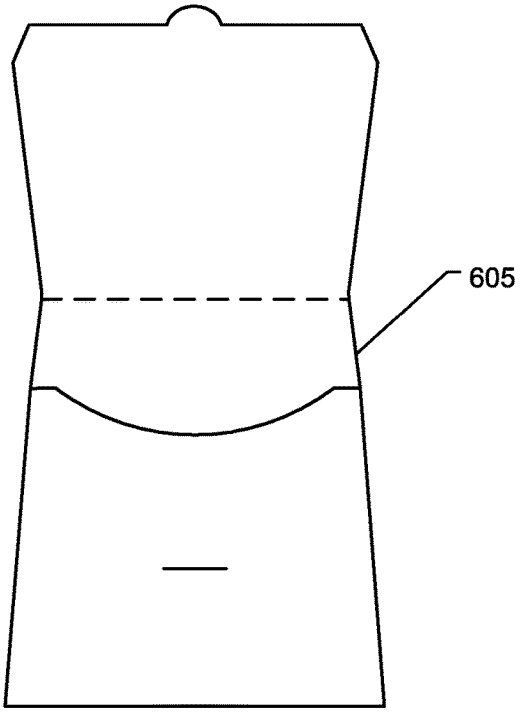
FIG. 39 is a front elevation view of the holder of FIGS. 35 and 36 showing the holder flap open.
Figure 40:
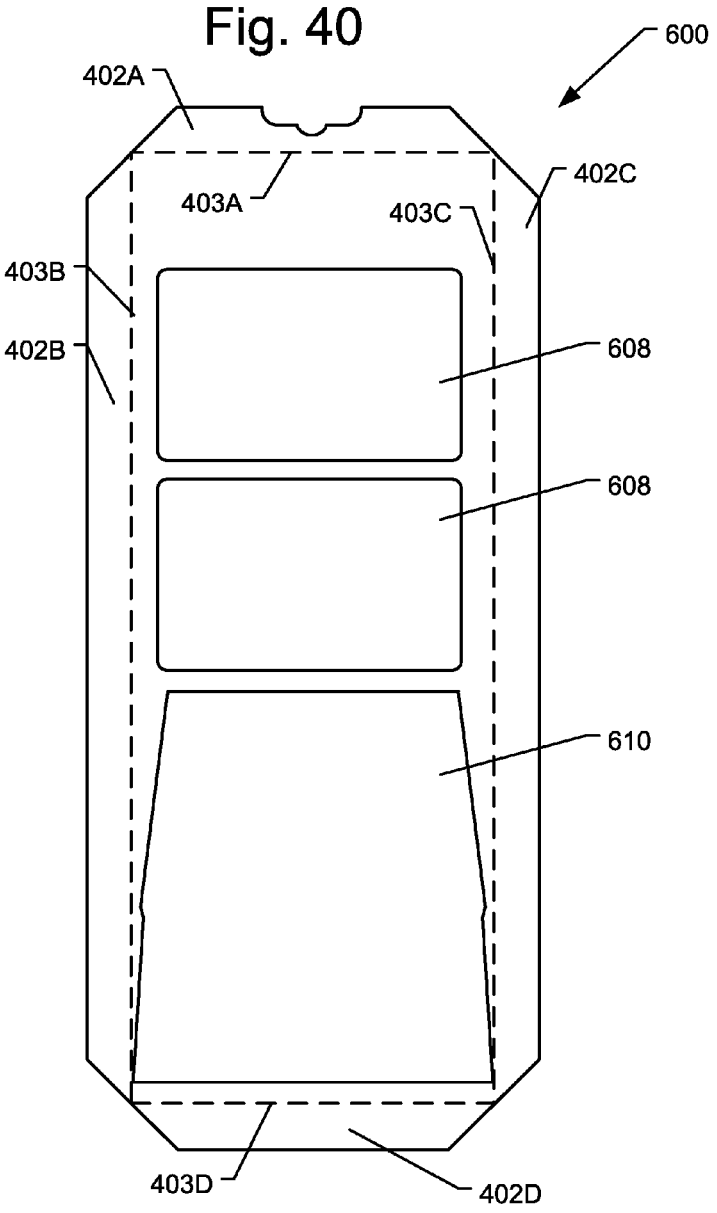
FIG. 40 is a top plan view of a clamshell cover typically comprising clear polyvinyl chloride.
Figure 41:
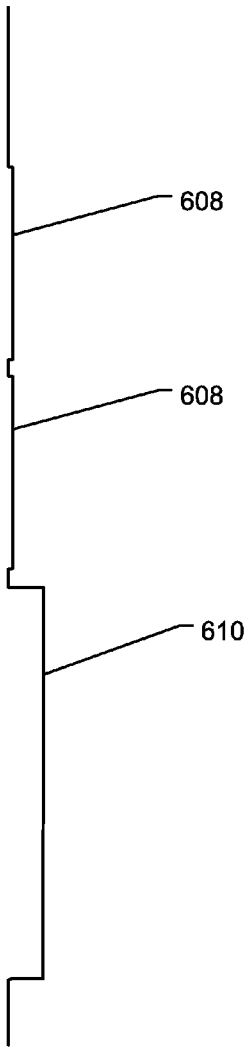
FIG. 41 is a cross sectional view of the cover of FIG. 40.

FIGS. 37-41 depict another embodiment of a card holder assembly 600. The card holder assembly 600 is similar to the card holder assembly 500 of FIGS. 31-34. However, the envelopes 604 of this embodiment are shaped like a bag, such as a purse or gift bag, as shown in FIGS. 38-39. In one aspect, the bag-shaped envelopes 604 are formed from a planar material 605, including but not limited to paper, cardstock, plastic, or any other suitable materials, that is cut and scored or folded to form a bag-shape. FIGS. 40-41 depict a clamshell cover 600 similar to the clamshell covers 400 and 506. The clamshell cover 600 includes a gift card holding portion 608 and an envelope holding portion 610. The envelope holding portion 610 is dimensioned to receive the bag-shaped envelopes 604.

Figure 42:
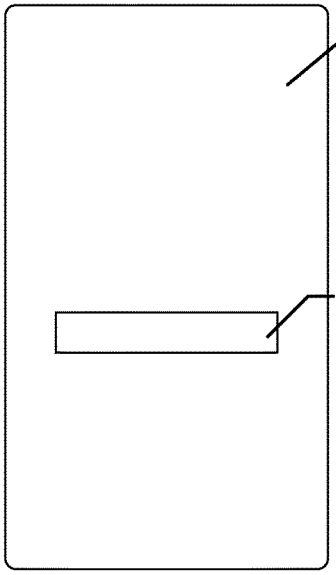
FIG. 42 is a front elevation view of a backer panel typically comprising cardboard or heavy paper and used for single or parent card activation.
Figure 43:
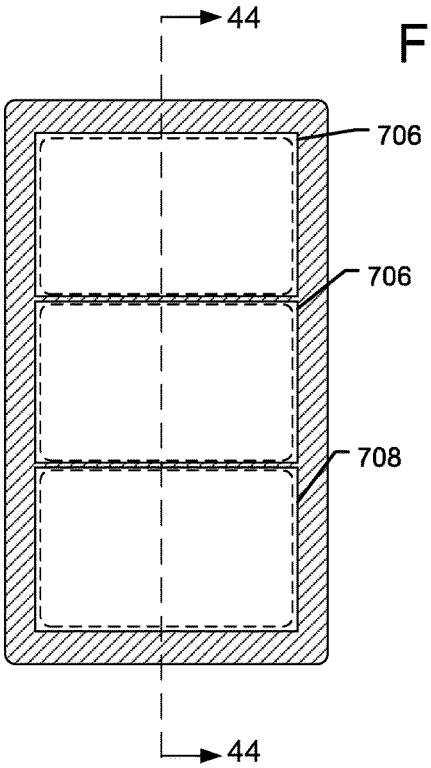
FIG. 43 is a rear view of a clamshell cover typically comprising clear, molded polyvinyl chloride, acetate, or PETG, the shaded portions indicating adhesive for adhering the cover to the backer panel of FIG. 42.
Figure 44:
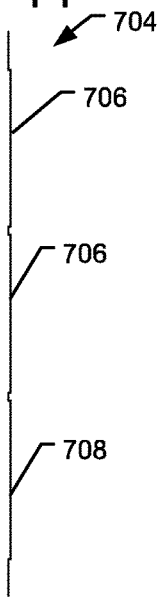
FIG. 44 is cross sectional view of the cover of FIG. 43.

FIG. 42 depicts a backer panel 700 that defines an opening 702 for single activations, wherein a single activation indicia is used to active all of the gift card, such as gift cards 105, that may be attached to the backer panel. FIG. 43 depicts a clamshell cover 704 that may be adhered to the backer panel 700. As shown, the clamshell cover 704 may define one or more card holding portions 706, an envelope holding portion 708, and a peripheral region 710 about the periphery of the clamshell cover that may receive an adhesive for attachment to the backer panel 700. FIG. 44 is a cross-sectional view of the clamshell cover 704 as view along line 44-44 in FIG. 43.

Figure 45:
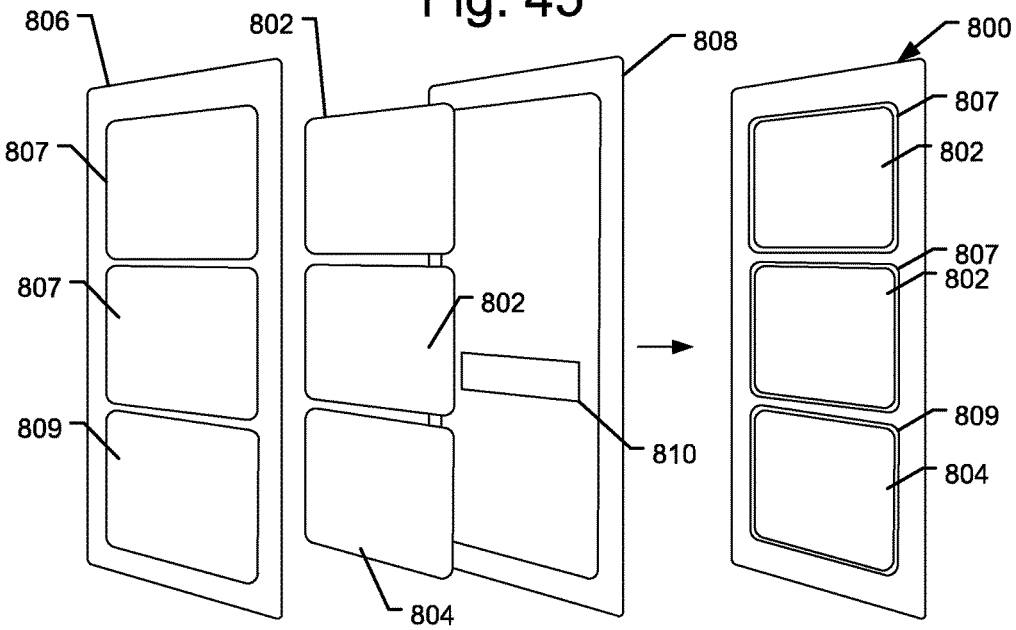
FIG. 45 is a diagram showing an example assembly process for providing a card holder assembly using a cover, transaction cards, and backer panel, according to one embodiment.

FIG. 45 depicts an example assembly process for providing a card holder assembly 800, such as card holder assemblies 100, 400, 500, and 600, among others. As shown, one or more gift cards 802 and envelopes 804 are arranged and placed between a clamshell cover 806, having regions dimensioned to hold gift cards and envelopes, 807 and 809, respectively, and a backer panel 808. As shown the backer panel 808 is configured for single activation by defining an opening 810 where activation indicia on one of the gift cards may be accessible through the opening. The clamshell cover 806 may be attached to the backer panel 808 through any suitable arrangement including but not limited to an adhesive, stables, or by folding a portion of the clamshell portion to surround and engage a portion of the backer panel.

It should be appreciated that the holder assembly and its associated structures may be constructed in various shapes and forms and may bear various graphics and designs while maintaining the general structure and functionality described herein. For example, in various embodiments, the activation indicia may be printed on or affixed directly to the backer panel.

It is believed that the present disclosure and many of its attendant advantages will be understood by the foregoing description, and it will be apparent that various changes may be made in the form, construction, and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context of particular implementations. Functionality may be separated or combined in blocks differently in various embodiments of the disclosure or described with different terminology. These and other variations, modifications, additions, and improvements may fall within the scope of the disclosure as defined in the claims that follow.

Those skilled in the art will appreciate that variations from the specific embodiments disclosed above are contemplated by the invention. The following invention should not be restricted to the above embodiments, but should be measured by the following claims.

What is claimed is:

1. A card holder assembly comprising:

an elongated backer panel defining at least one transaction card receiving region, wherein the elongated backer panel extends beyond the at least one transaction card receiving region;

at least one transaction card;

at least one transaction card holder;

a cover enclosure comprising one or more extended margins, the cover enclosure defining at least one transaction card portion dimensioned to hold the at least one transaction card and defining at least one transaction card holder portion dimensioned to hold the at least one transaction card holder, the extended margins defining at least one area that extends beyond the transaction card holder portion and the transaction card portion;

wherein the extended margins engage the elongated backer panel; and wherein the at least one transaction card and the at least one transaction card holder are removably attached to the elongated backer.

2. The card holder assembly of claim 1 wherein the elongated backer panel comprises at least one activation aperture to access activation indicia on the at least one transaction card positioned within the at least one transaction card portion.

3. The card holder assembly of claim 2, wherein the activation indicia is machine-readable to activate the at least one transaction card.

4. The card holder assembly of claim 3, wherein the activation indicia comprises a magnetic strip or a bar code.

5. The card holder assembly of claim 1 wherein the elongated backer panel comprises at least one activation indicia.

6. The card holder assembly of claim 5, wherein the activation indicia is machine-readable to activate the at least one transaction card.

7. The card holder assembly of claim 6, wherein the activation indicia comprises a magnetic strip or a bar code.

8. The card holder assembly of claim 1, wherein the cover enclosure is transparent.

9. The card holder assembly of claim 1, wherein at least one of the at least one transaction card portion and the at least one transaction card holder portion is transparent.

10. The card holder assembly of claim 1, wherein the cover enclosure is engaged to a front surface of the backer panel by an adhesive.

11. The card holder assembly of claim 10, wherein the adhesive is placed around a periphery of the cover enclosure.

12. The card holder assembly of claim 1 wherein the at least one transaction card portion is dimensioned to hold two or more transaction cards.

13. The card holder assembly of claim 12 wherein the two or more transaction cards are stacked.

14. The card holder assembly of claim 12 wherein the two or more transaction cards are in a fanned stack arrangement.

15. The card holder assembly of claim 1 wherein the at least one transaction card holder portion is dimensioned to hold two or more transaction card holders.

16. The card holder assembly of claim 15 wherein the two or more transaction card holders are stacked.

17. The card holder assembly of claim 1 wherein the at least one transaction card holder is an envelope.

18. The card holder assembly of claim 1 wherein the at least one transaction card holder has a bag shape.

* * * * *